United States Patent [19]

Parsonage

[11] 3,997,347

[45] Dec. 14, 1976

[54] METHOD AND APPARATUS FOR RECYCLING PHOTOGRAPHIC WASH WATER

[75] Inventor: Harry N. Parsonage, Dayton, Ohio

[73] Assignee: The Mead Corporation, Dayton, Ohio

[22] Filed: Apr. 22, 1974

[21] Appl. No.: 462,884

[52] U.S. Cl. ..... 96/50 R; 96/50 A; 96/63

[51] Int. Cl.[2] ..... G03C 5/26; G03C 5/24

[58] Field of Search ..... 96/50 R, 50 A, 61, 63, 96/66, 60 R; 210/47

[56] References Cited

UNITED STATES PATENTS

| | | | |
|---|---|---|---|
| 3,186,942 | 6/1965 | Benger | 210/63 |
| 3,531,284 | 9/1970 | Armstrong et al. | 96/61 R |
| 3,721,624 | 3/1973 | Fisch et al. | 96/61 R |
| 3,813,246 | 5/1974 | Schranz et al. | 96/60 BF |

FOREIGN PATENTS OR APPLICATIONS

| | | |
|---|---|---|
| 2,113,612 | 5/1972 | France |

OTHER PUBLICATIONS

1951, Photographic Engineering, vol. 2, No. 3, pp. 148–160, by Levinos, "Stabilization Processing."
West, Photo Sci. & Eng., vol. 9, 1965, pp. 398–413.

*Primary Examiner*—Mary F. Kelley
*Attorney, Agent, or Firm*—Biebel, French & Nauman

[57] ABSTRACT

Disclosed are a method and apparatus for processing spent photographic wash water, so that it may be recycled for reuse in the washing step of a photographic developing process, involving passing the spent wash water through an oxidation reaction apparatus to convert any thiosulfate salts in the spent wash water to sulfate salts, and then returning the sulfate water to the developing process for reuse as wash water. In the reactor, the thiosulfate salts in the wash water react in the presence of an oxidation catalyst with oxygen from spent drying air passed to the reactor.

5 Claims, 1 Drawing Figure

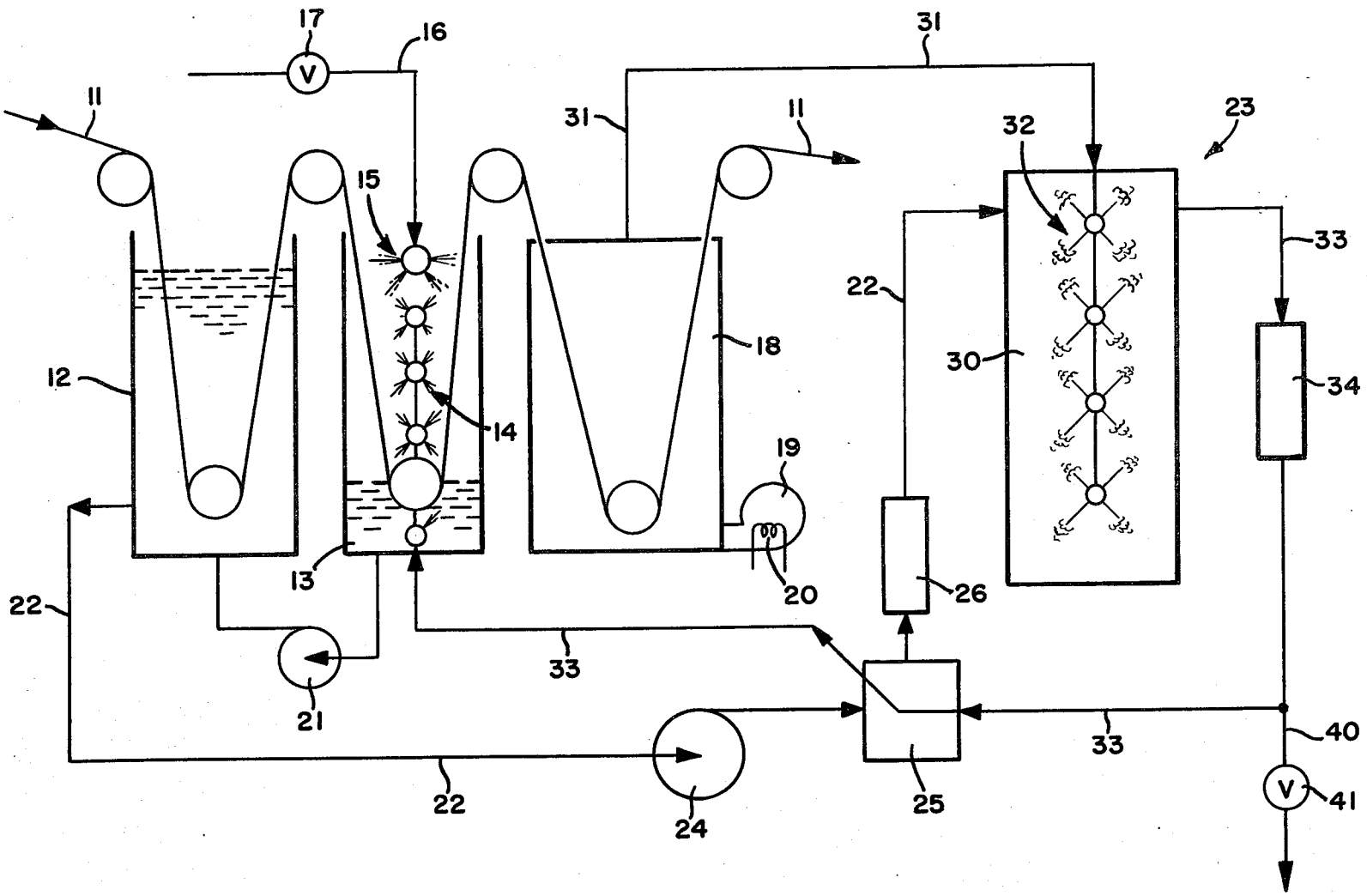
11
12
13
14
15
16
17
18
19
20
21
22
23
24
25
26
30
31
32
33
34
40
41

METHOD AND APPARATUS FOR RECYCLING PHOTOGRAPHIC WASH WATER

BACKGROUND OF THE INVENTION

The present invention relates to a method and apparatus for washing developed photographic materials, and more particularly to a method and apparatus for processing spent wash water for reuse in the washing step.

During the silver halide photography developing process, the photographic material is passed through a fixing bath which makes permanent the development of the film, i.e., fixes the film by removing silver halide from the undeveloped areas. Generally, the fix bath comprises a solution of thiosulfate salts such as sodium, potassium, or ammonium thiosulfate, or combinations thereof, commonly known as hypo. The fixing step is ordinarily the final step before the film is fully developed, but it also usually undergoes further rinsing and drying steps to remove any developing chemicals remaining on the film, including the chemicals from the fix bath.

Incomplete washing results in retention of thiosulfates and argentothiosulfates which can have adverse effects on the photographic image. Reduction of silver complexes, such as $Ag(S_2)_3^{-1}$ and $Ag)S_3O_2)_2^{-3}$, to metallic silver can result in a stain that is most obvious in nonimage areas. Presence of thiosulfates can result in sulfiding of the image silver, causing discoloration. Under conditions of low pH, thiosulfate enters into a reaction with finely divided metallic silver in the presence of oxidizing agents such as dissolved oxygen, oxidized developing agents, or even decomposition products of thiosulfate including polythionates and sulfur. Thus, the washing step removes salt crystals which cause streaks on the film, and the drying removes the water which would cause spots. Generally in the past, the spent wash water containing the rinsed-off chemicals was passed to the sewers in an untreated state, while the spent drying air was passed to the atmosphere.

These traditional photographic washing and drying processes have been criticized recently because unlimited fresh water for washing or rinsing the film is no longer available. This is due in part to polluted streams and population demands on potable water. Further, unrestrained discharge of spent wash water and drying air into the sewer systems, and atmosphere can no longer be tolerated. The chemicals consume oxygen in the discharge streams as the chemicals break down or are converted to more basic or stable forms. For example, thiosulfate salts from the fix solution will consume oxygen in a stream of water into which it is discharged to achieve the more stable sulfate state. This consumption of oxygen is a further pollution of the streams. It reduces the amount of dissolved oxygen otherwise available to support marine life. This consumption or reduction of the dissolved oxygen in the streams is referred to as biological or biochemical oxygen demand (BOD) and chemical oxygen demand (COD).

Another problem with the traditional photographic washing and drying processes has been their inability or difficulty in adapting to mobile film developing situations. When film must be developed in mobile film centers, such as aboard ships or airplanes or in isolated Army field units, there are limitations on the source of supply and quantity of good quality water. Further, the disposal of large quantities of spent wash water may also prove to be difficult and/or a pollution of the streams supplying the wash water.

No photographic washing process has been found which in both nonpulluting and water conserving. Technical Report AFFDL-TR-69-10, February, 1969, entitled "Methods of Conserving and Reclaiming Photographic Wash Water for Reuse", by J. Brennan Gisclard, prepared for the Air Force Flight Dynamics Laboratory, Air Force Systems Command, Wright-Patterson Air Force Base, Dayton, Ohio, discusses the desirability and need for conserving water by recycling photographic wash water. But, the Gisclard report is only a study of ways of conserving water by recycling the photographic wash water, and the effects of the recycled wash water on the film. It does not deal with, nor does it teach, reducing pollutants in the discharge streams, and further only "commercial" quality film is achieved. The reports concludes that wash water may be recycled as much as ten times, with the presence and build-up of salts in the recycled wash water not necessarily adversely affecting the film. The Gisclard report also discloses that an additional rinse may be necessary to remove loose residual salts from the film surface, apparently because the wash water contains a high thiosulfate salt buildup. Thus, while Gisclard teaches water conservation, the recycled wash water when discharged would still contain polluting thiosulfate salts. In fact, it would appear to be even more polluting because of the buildup from recycling.

U.S. Pat. No. 3,531,284 also deals with the problem of reducing clean water consumption, but without effecting reduction of photographic pollutants. A method and apparatus for washing photographic material are disclosed which use a closed loop water reclamation system in combination with an ion exchange technique for washing the film. The reclamation system is actually a heat pump or distillation apparatus which reduces the concentration and contamination level of the fixing chemicals, including thiosulfate salts, in the wash water. While water is conserved, the process and apparatus of U.S. Pat. No. 3,531,284 requires a cleaning step to remove scale buildup, including thiosulfates salts removed from the wash water, and the discharge of that scale would pollute. Further, additional energy is consumed in the process because large amounts of energy are required to run the evaporators and complementary refrigeration equipment.

U.S. Pat. No. 3,186,942 teaches the elimination of sulphides in effluents in the spent alkaline wash liquors obtained in petroleum refineries. The sulfides are treated by an oxidation process using copper or iron group catalysts to convert the sulfides to thiosulfates and then to sulfates. In this way, the oxygen consumption of the effluents in the stream is reduced because the sulfate is a more stable salt. But, this process is not disclosed for use in a photographic developing process, and it does not deal with the water conservation problem associated with the rinsing or washing step in such processes.

Thus, a need exists for a method of washing developed photographic material which reduces the amount of wash water necessary to wash the film, which minimizes the amount of spent wash water discharged, and which minimizes the amount of polluting chemicals in the discharge stream.

SUMMARY OF THE INVENTION

Disclosed is a method and apparatus for recycling wash water in a photographic process. This invention in particular relates to a process and apparatus for treating spent wash water to reduce the thiosulfate salts therein so that the water may be reused to conserve water in the washing processes, and may be discharged without polluting.

In the preferred process, spent wash water from the washing apparatus is passed through an oxidation apparatus comprising a reaction vessel containing treated particles of an oxidation catalyst, such as wet-proofed carbon particles and the like. The spent wash water is contacted with warm moist air exiting from the drying apparatus. The thiosulfates, from the fix solution, in wash water are reacted with oxygen in the air to convert the thiosulfates to sulfates in the presence of the carbon catalyst particles. The thus processed wash water or sulphate water is returned to the photographic process for reuse in washing more of the developed film. Additionally, a small amount of fresh, uncontaminated water may be sprayed on the film as a second and/or final rinse, and the spent spray or rinse water combined and treated along with the spent wash water.

Thus, in the process of the invention the spent wash water is able to be recycled resulting in the conservation of water since less fresh water is necessary than it is necessary in the traditional washing process. Fresh water needs can be reduced 95 to 98% over conventional washing processes. For a mobile film processing center, this could mean that 5 gallons of additive water would last all day.

Also, the conversion of the thiosulfate salts in the spent wash water to sulfate salts means that when some of the processed spent wash water is finally sewered, it will be less polluting than the traditional washing processes. As much as 70 to 80% reduction in BOD and 50% reduction in COD can be effected.

Further, it was discovered that the use of the additional spray-rinse will result in a finished and developed film product that is of "archival" quality, as compared to those processes wherein mere commerical quality was achieved. Archival quality means that the film can be stored in the U.S. Archives without deterioration, and requires that there be less than five micrograms per square inch of residual thiosulfate, when measured by the Warburton methylene blue test. Using 98% recycled wash water, the salt content in the wash water bath can be kept to around 2 to 3% dissolved salts, and Archival quality or better can be achieved. So, the wash water recycling process and apparatus of the invention not only is water conserving and nonpolluting, but it is also able to achieve high quality washing of the developed film.

It is therefore an object of the invention to provide a method and apparatus for recycling the wash water in the photographic process such that water can be conserved and pollution can be reduced.

Other objects and advantages of the invention will be apparent from the following description, the accompanying drawings and the appended claims.

BRIEF DESCRIPTION OF THE DRAWING

The sole FIGURE of the drawing shows, diagrammatically, a schematic illustration of the washing and drying steps of a film developing process, including the recycling of the wash water in accordance with the teachings of the invention.

DESCRIPTION OF THE PREFERRED EMBODIMENT

The method and apparatus of the invention are illustrated in the figure wherein film 11 after passing through a fixing bath of hypo or thiosulfate salts, undergoes a washing step to remove any excess chemicals from the film surface, including the salts from the fix bath. After washing, the film is dried to remove any water remaining on the film from the washing step.

As illustrated, film 11 is passed through a first wash tank 12 where the film is given a first rinse by immersing it in wash water which is being recycled by passing it through a processing apparatus which will be described in more detail hereinafter. In a second wash tank 13, the film is given two other rinses. A second rinse is provided by spray 14 of recycled wash water, and a third rinse by spray 15 of fresh or uncontaminated water. The fresh water is supplied by a pipe 16 from any conventional source (not shown) through a control valve 17, which controls the rate of flow of the fresh water and shuts off the supply when not in use. The spray heads can be of a conventional design and construction, as their purpose is to merely provide a final rinse for film 11. Single or plural spray nozzles may be used to spray one or both sides of the film, depending upon the particular need.

After the spray rinse, film 11 is passed through a dryer 18 of any conventional construction or type, but generally comprising a chamber wherein warm circulating air supplied by a blower 19 passing air across a heating element 20. The precise size of the blower and heater will depend upon the amount of film processed, etc., and their size and construction are not critical as long as they are able to remove the residual moisture from the film without damaging it. Film 11 exits from the dryer and passes to other film processing steps (not shown), such as cutting, coiling, printing and the like.

The spray rinses of fresh and recycled wash water are collected in the botton of tank 13 and are added to the recycled wash water already in first wash tank 12 by a conventional pump 21. From first wash tank 12, the spent wash water exits via pipe 22 to be processed for recycling. In this way, the film is rinsed with three rinses each of which is progressively less contaminated with fix chemicals and the like, with some of the most contaminated rinse water being drained off for processing. Alternatively, the second wash tank may provide only a second rinse of the film, with the fresh or uncontaminated water, and then each tank may then be drained as spent wash water to be processed for recycling.

The oxidation equipment 23 converts sulfite and thiosulfate salts in the spent wash water to sulfate salts. By oxidizing the thiosulfates to sulfates, the spent wash water can be reused while achieving archival quality washed film. Also, when any of the processed wash water is sent to the sewer, any polluting thiosulfates will have been oxidized to the more stable sulfates. The oxidation reaction which occurs is generally as follows:

$$S_2O_3^{--} + 6\tfrac{1}{2}O_2 + 8H^+ \rightarrow 2SO_4^{--} + 8OH^-$$

The oxidation equipment 23 generally comprises a reactor 30 and appropriate piping to flow the reactants into and out of reactor 30. Reactor 30 comprises a reaction vessel, such as a closed cylindrical tank or the like, containing a packed bed of an appropriate catalyst for converting the thiosulfates in the spent wash water to sulfates. One such catalyst could be for example, carbon catalyst particles which are wetproofed by having surface portions in contact with a hydrophobic material such as polytetrafluoroethylene without being completely encapsulated by the hydrophobic material, such as is disclosed in Smith et al U.S. Pat. application Ser. No. 356,469, filed May 2, 1973, now abandoned in favor of continuation application Ser. No. 517,246, filed Oct. 23, 1974, the disclosure of which is incorporated herein by reference.

It may be desirable to control the pH of the wash water to prevent possible harm to the emulsion, such as softening and the like. If so, the pH may be controlled by an appropriate apparatus, either before or after the oxidation reaction means. Normally in color developing processes an acid fixing bath is used, and so the necessary pH will be automatically maintained. The preferred pH is between 4.5 and 7.0. Below 4.5 results in an accumulation of sulfides, and above 7.0 slows the oxidation reaction. When adjustments are to be made to the pH, it is preferrable to do so before the spent wash water is sent to the oxidation equipment to insure the proper reaction conditions in the reactor.

In operation, spent wash water 22 from tank 12 is pumped by an appropriate pump 24 first through a heat exchanger 25, and second through a heater 26, to reactor 30 where it is contacted with spent warm moist air from dryer 18 through pipe 31. The oxidation reaction rate is increased at higher temperatures, and so heat exchanger 25 is used to increase the temperature of the spent wash water containing contaminents to be oxidized, by using the heat from the reacted wash water being recycled. An additional increase in the temperature of the spent wash water, if necessary, is achieved by heater 26. The oxygen in the spent air, which is despersed in reactor 30 by a conventional air dispersing apparatus 32, reacts with the thiosulfates in the spent wash water in the presence of the catalyst particles to oxidize the thiosulfates to sulphates. The processed spent wash water or sulfate water is then recycled back to the washing system and washing tank 12 by line 33, via heat exchanger 25, so that it may be reused as wash water. An appropriate filter 34 may be placed in line 33 to filter out any catalyst particles and the like which may escape from reactor 30.

The oxidation reaction need not involve the spent air from the dryer, and so could use fresh air or even pure oxygen. There are several advantages in using the spent, warm, moist air from the dryer, though. The warmer air increases the reaction rates and the temperature of the wash water, which has an improvement in washing hypo from the film. Further, additional fresh air need not be needlessly involved or consumed, and any entrained particles of chemical containing moisture in the spent air exiting from the dryer will be mixed with the wash water, and removed from the reactor exiting from the air to minimize further air pollution.

The air, less reacted oxygen, will normally exit from reactor 30 via line 33 along with the recycled wash water. Since the recycled wash water is used as the first spray rinse (actually the second rinse step), not separating the oxygenless air from the wash water to be recycled is a convenience and saves a further airation step. Alternatively, the oxygenless air could be separated from the converted or sulfate water, passed through an entrainment separator, such as a cyclone separator or the like, to remove entrained water particles, and then vented to the atmosphere. The sulfate wash water would then be circulated back to the washing apparatus.

Since a relatively small amount of water is added to the recycled wash water system, while there are practically no losses, it will usually be necessary to remove an amount of water approximately equal to the amount added. This can be done by a simple drain system such as pipe 40 and valve 41. Sulfate water from return line 33 is drained in am amount equal to that added by fresh water line 16, and controlled by valve 17. Thus, drain valve 41 can be set for a flow rate approximately equal to fresh water input valve 17, when the flow rate and film speeds are relatively constant, and the amount of input should equal the amount of output. Further, the material drained to the sewer is not as polluting as the wash water since it has been oxidized. Alternatively, the overflow could be connected to the first wash tank, as by an overflow line which drains wash water from the tank when it exceeds a certain level. Also, the liquid could be collected for reverse osmosis or other processing.

While the methods herein described, and the forms of apparatus for carrying these methods into effect, constitute preferred embodiments of this invention, it is to be understood that the invention is not limited to these precise methods and forms of apparatus, and that changes may be made in either without departing from the scope of the invention.

What is claimed is:

1. A method of recycling the wash water in a photographic process, wherein, after having been developed, the film undergoes a final washing or rinsing step in a washing apparatus and a drying step in a drying apparatus to remove any chemicals, including thiosulfate salts from the fix solution, from the film surface comprising the steps of:

a. passing wash water from the film washing apparatus containing chemicals rinsed from the film to an oxidation means comprising a reaction vessel containing wetproofed carbon particles having surface portions in contact with polytetrafluoroethylene resin without being completely encapsulated by said resin;

b. passing warm moist air from the drying apparatus to said oxidation means;

c. reacting the thiosulfate salts in said wash water with oxygen in said air in the presence of said wetproofed carbon particles in said oxidation means to oxidize said thiosulfate salts to sulfate salts; and d. return said water to the photographic process for reuse in washing the developed film.

2. A method as in claim 1 further including the steps of rinsing the developed film with a small amount of fresh, uncontaminated water after washing said film with said returned wash water.

3. In the processing of photographic material including at least the steps of exposing, developing and washing said material with water to remove metal thiosulfate salts therefrom, the improvement comprising passing spent wash water through an oxidation means containing wetproofed carbon particles having surface portions in contact with polytetrafluoroethylene resin without being completely encapsulated by said resin, to contact said spent wash water with air or oxygen, in the presence of said wetproofed carbon particles to convert said metal thiosulfate salts to sulfate salts and reusing said converted wash water to wash photographic materials.

4. The process of claim 3 further including the further steps of washing said photographic materials with fresh, uncontaminated water and thereafter combining said spent fresh wash water with said spent wash water for further processing.

5. A method of washing film developed by a photographic process comprising the following steps:

a. passing said film through a first rinse by immersing the film in a tank of recycled wash water b. passing said film through a second rinse by spraying recycled wash water on said film, c. passing said film through a third rinse by spraying fresh, relatively uncontaminated un-recycled wash water on said film, d. passing said film through a dryer to remove any moisture remaining on said film from said rinsing steps, e. collecting the spent rinse water from said second and third rinses and passing it to said tank of recycled wash water for use in said first rinsing step, f. passing spent wash water from said recycled wash water tank to a reactor means for oxidizing any thiosulfate salts from the fix solution which are in said spent wash water and which were rinsed off said film to sulfate salts, g. passing the spent drying air from said dryer to said reactor means, h. Reacting said thiosulfate salts in said spent rinse water with oxygen in said spent drying air, in the presence of an oxidizing catalyst of carbon particles having surface portions in contact with polytetrafluoroethylene resin without being completely encapsulated by said resin to convert said thiosulfates to sulfates and to convert said spent wash water to sulfate water to be recycled, and i. Passing said sulfate water to the washing apparatus for use as recycled water in said second rinsing step.

* * * * *